US011482160B2

(12) United States Patent
Tsai et al.

(10) Patent No.: US 11,482,160 B2
(45) Date of Patent: Oct. 25, 2022

(54) DRIVING DEVICE AND DRIVING METHOD OF DISPLAY PANEL TO DETECT WHETHER SUB-PIXEL CIRCUIT IS IN ABNORMAL OPEN STATE

(71) Applicant: Novatek Microelectronics Corp., Hsinchu (TW)

(72) Inventors: Yi-Yang Tsai, Hsinchu County (TW); Chun-Fu Lin, Taoyuan (TW); Po-Hsiang Fang, Hsinchu County (TW); Jhih-Siou Cheng, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/074,639

(22) Filed: Oct. 20, 2020

(65) Prior Publication Data

US 2022/0122521 A1 Apr. 21, 2022

(51) Int. Cl.
*G09G 3/32* (2016.01)
*H05B 45/325* (2020.01)

(52) U.S. Cl.
CPC ..... *G09G 3/32* (2013.01); *H05B 45/325* (2020.01); *G09G 2310/0267* (2013.01); *G09G 2310/0272* (2013.01)

(58) Field of Classification Search
CPC ... G09G 3/32–3291; G09G 2310/0267; G09G 2310/0272; G09G 2310/0275; G09G 2310/0289; G09G 2310/08; G09G 2320/02; G09G 2320/0233; G09G 2320/0242; G09G 2320/043; G09G 2320/045; G09G 2320/0633; G09G 2320/064; G09G 2330/028; G09G 2330/04; G09G 2330/08–12; G09G 2300/0421; G09G 2300/0426; G09G 2300/0439; G09G 2300/0469; G09G 2300/0809; G09G 2300/0819; H05B 45/00; H05B 45/325
See application file for complete search history.

(56) References Cited

U.S. PATENT DOCUMENTS

2005/0285625 A1* 12/2005 Kimura ..... G09G 3/3241 326/83
2008/0315788 A1* 12/2008 Levey ..... G09G 3/3233 315/291

(Continued)

*Primary Examiner* — Nathan Danielsen
(74) *Attorney, Agent, or Firm* — JCIPRNET

(57) ABSTRACT

A driving device and a driving method of a display panel are provided. The driving device includes a current source and a control circuit. The current source makes a driving current flow through a light-emitting element path of a sub-pixel circuit of the display panel. During a display line period, the driving current has a normal current amount, and the control circuit controls a first switch in the light-emitting element path to adjust a duty cycle of the driving current in the light-emitting element path. During a sensing period, the driving current has a sensing current amount less than the normal current amount, the control circuit turns on the first switch, and the control circuit checks a voltage in the light-emitting element path to determine whether a light-emitting element in the light-emitting element path is open (or whether the light-emitting element is provided in the light-emitting element path).

10 Claims, 6 Drawing Sheets

(56) References Cited

U.S. PATENT DOCUMENTS

| | | | | |
|---|---|---|---|---|
| 2013/0002639 | A1* | 1/2013 | Park | H02M 3/156<br>345/212 |
| 2013/0328848 | A1* | 12/2013 | Chao | G09G 3/3266<br>345/211 |
| 2017/0345286 | A1* | 11/2017 | Liang | H05B 45/10 |
| 2018/0144674 | A1* | 5/2018 | Gupta | G09G 3/3266 |
| 2020/0143753 | A1* | 5/2020 | Park | G09G 3/3233 |
| 2020/0312216 | A1* | 10/2020 | Kim | G09G 3/2014 |

* cited by examiner

DRIVING DEVICE AND DRIVING METHOD OF DISPLAY PANEL TO DETECT WHETHER SUB-PIXEL CIRCUIT IS IN ABNORMAL OPEN STATE

BACKGROUND

Technical Field

The disclosure relates to a display apparatus, and in particular, relates to a driving device and a driving method of a display panel.

Description of Related Art

A light-emitting diode (LED) may act as a light-emitting element in a sub-pixel circuit of a display panel. When an unexpected factor occurs, the LED disposed in the sub-pixel circuit may be detached (no LED is provided in the sub-pixel circuit). Alternatively, the LED in the sub-pixel circuit is open due to poor soldering. Alternatively, the LED in the sub-pixel circuit is open because the LED die is defective. The aforementioned situations are collectively referred to as an abnormal open state. If a certain sub-pixel circuit of the display panel is in the abnormal open state, when this sub-pixel circuit is selected to be lit, a voltage of a channel connected to this sub-pixel circuit is maintained at an unexpected high voltage level because a discharge path is not provided. This high voltage level may be coupled to an adjacent sub-pixel circuit, and the adjacent sub-pixel circuit is thereby abnormally lit. Detection of the sub-pixel circuit to see whether the sub-pixel circuit is in the abnormal open state to solve such problem is an important issue.

It should be noted that the contents disclosed in the "Description of Related Art" section is used for enhancement of understanding of the disclosure. A part of the contents (or all of the contents) disclosed in the "Description of Related Art" section may not pertain to the conventional technology known to people having ordinary skill in the art. The information disclosed in the "Description of Related Art" section does not mean that the content is known to people having ordinary skill in the art before the filing of the disclosure.

SUMMARY

The disclosure provides a driving device and a driving method of a display panel to detect whether a sub-pixel circuit is in an abnormal open state.

In an embodiment of the disclosure, the driving device includes a current source and a control circuit. The current source is configured to make a driving current flow through a light-emitting element path of at least one sub-pixel circuit of the display panel. The light-emitting element path includes a first switch. The control circuit is configured to control the current source to adjust the driving current and control the first switch to adjust a duty cycle of the driving current in the light-emitting element path. Herein, a sensing period is inserted into a display frame period, and the display frame period includes at least one display line period corresponding to the sub-pixel circuit. During the display line period, the control circuit adjusts the driving current to have an normal current amount, and the control circuit controls the first switch to adjust the duty cycle of the driving current in the light-emitting element path with at least one first pulse width modulation signal corresponding to at least one piece of sub-pixel data. During the sensing period, the control circuit adjusts the driving current to have a sensing current amount less than the normal current amount, the control circuit turns on the first switch with a second pulse width modulation signal corresponding to the sensing period, and the control circuit checks a voltage in the light-emitting element path to determine whether a light-emitting element in the light-emitting element path is open (or whether the light-emitting element is provided in the light-emitting element path).

In an embodiment of the disclosure, the driving method includes the following steps. A current source makes a driving current flow through a light-emitting element path of at least one sub-pixel circuit of the display panel. The light-emitting element path includes a first switch. The current source is controlled by a control circuit to adjust the driving current. The first switch is controlled by the control circuit to adjust a duty cycle of the driving current in the light-emitting element path. A sensing period is inserted into a display frame period, and the display frame period includes at least one display line period corresponding to the sub-pixel circuit. During the display line period, the control circuit adjusts the driving current to have an normal current amount, and the control circuit controls the first switch to adjust the duty cycle of the driving current in the light-emitting element path with at least one first pulse width modulation signal corresponding to at least one piece of sub-pixel data. During the sensing period, the control circuit adjusts the driving current to have a sensing current amount less than the normal current amount, the control circuit turns on the first switch with a second pulse width modulation signal corresponding to the sensing period, and the control circuit checks a voltage in the light-emitting element path to determine whether a light-emitting element in the light-emitting element path is open (or whether the light-emitting element is provided in the light-emitting element path).

To sum up, in the driving device and the driving method of the display panel provided by the embodiments of the disclosure, the sensing period may be inserted into the display frame period. Accordingly, the driving device may perform sensing (detecting) at any time during the display period. The sensing current amount of the driving current in the sensing period is less than the normal current amount of the driving current in the display line period, so that a user may not be easily (or is not) aware of the performance of sensing (detecting). The control circuit may check the voltage in the light-emitting element path during the sensing period, so as to detect (determine) whether the sub-pixel circuit is in the abnormal open state.

To make the aforementioned more comprehensible, several embodiments accompanied with drawings are described in detail as follows.

DESCRIPTION OF THE EMBODIMENTS

Figure 1A:
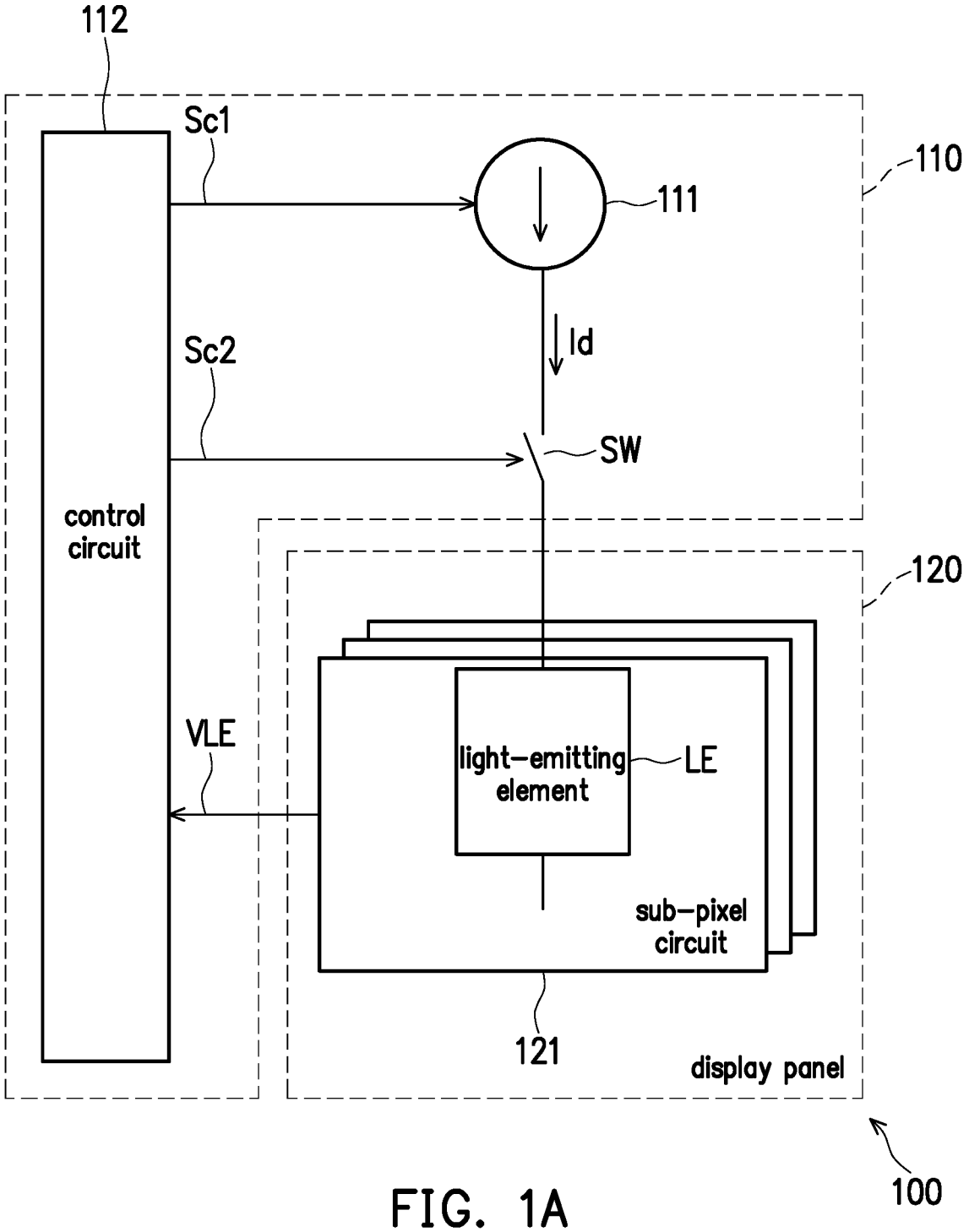
FIG. 1A and FIG. 1B are schematic diagrams of circuit blocks of a display apparatus according to different embodiments of the disclosure.

The term "coupled to (or connected to)" used in the entire disclosure (including claims) refers to any direct or indirect connecting means. For example, if the disclosure describes a first apparatus is coupled to (or connected to) a second apparatus, the description should be explained as the first apparatus that is connected directly to the second apparatus, or the first apparatus, through connecting other apparatus or using certain connecting means, is connected indirectly to the second apparatus. In addition, terms such as "first" and "second" in the entire specification (including claims) are used only to name the elements or to distinguish different embodiments or scopes and should not be construed as the upper limit or lower limit of the number of any element and should not be construed to limit the order of the elements. Moreover, elements/components/steps with the same reference numerals represent the same or similar parts in the figures and embodiments where appropriate. Descriptions of the elements/components/steps with the same reference numerals or terms in different embodiments may be references for one another.

Figure 1B:
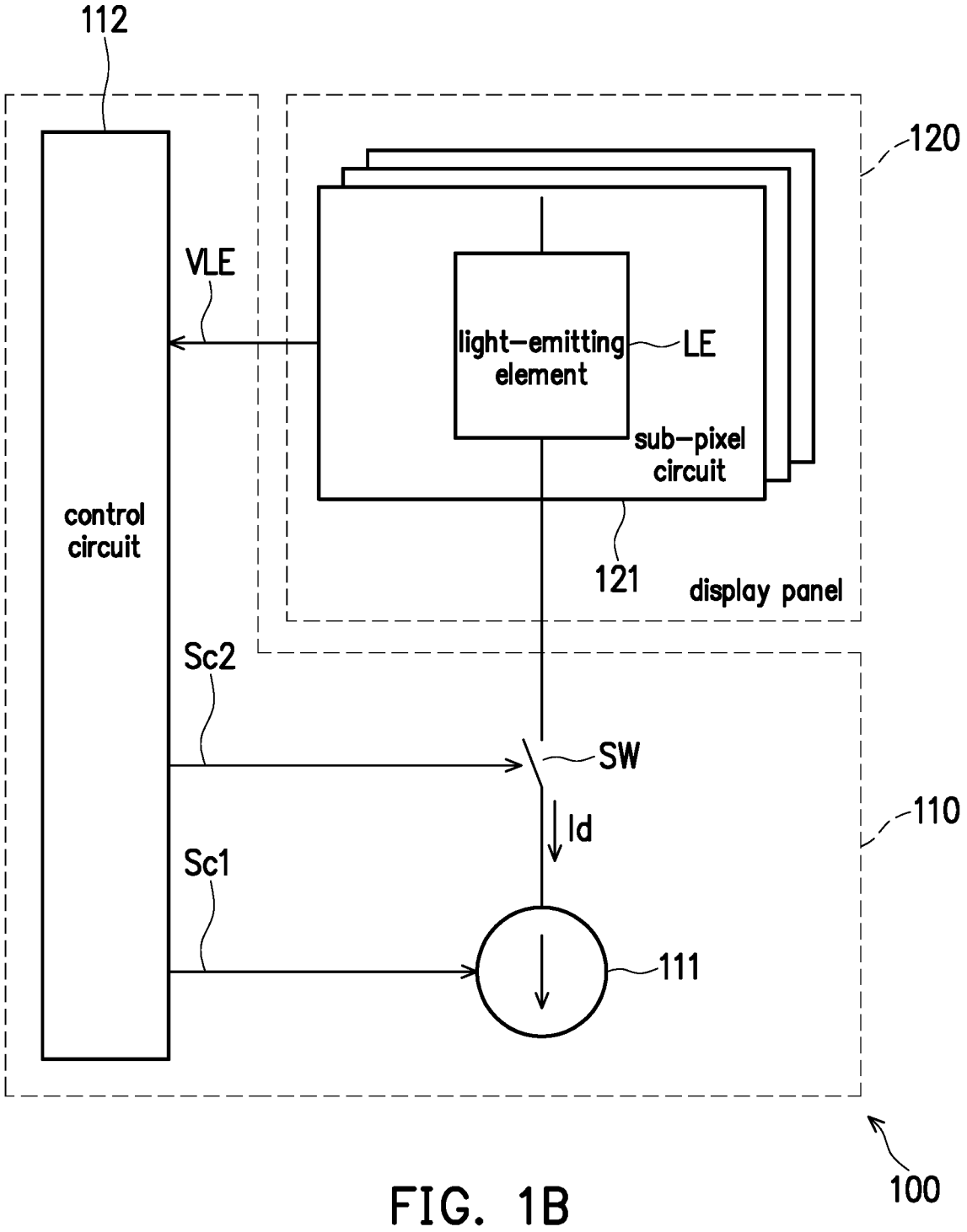

FIG. 1A and FIG. 1B are schematic diagrams of circuit blocks of a display apparatus 100 according to different embodiments of the disclosure. The display apparatus 100 shown in FIG. 1A and FIG. 1B includes a driving device 110 and a display panel 120. According to design requirements, the display panel 120 may include a passive matrix light emitting diode (PMLED), an active matrix light emitting diode (AMLED) or other light emitting element matrix. The display panel 120 includes a sub-pixel array, and the sub-pixel array includes a plurality of sub-pixel circuits (e.g., a sub-pixel circuit 121 shown in FIG. 1A and FIG. 1B). The sub-pixel circuit 121 includes a light-emitting element LE. The switch SW and the light-emitting element LE are connected in series to provide a light-emitting element path (current path). According to design needs, the light-emitting element LE may include a light-emitting diode (LED) or other light-emitting elements. For example (but not limited to this), the display panel 120 shown in FIG. 1A may include a conventional common cathode PMLED, and the display panel 120 shown in FIG. 1B may include a conventional common anode PMLED.

Figure 2:
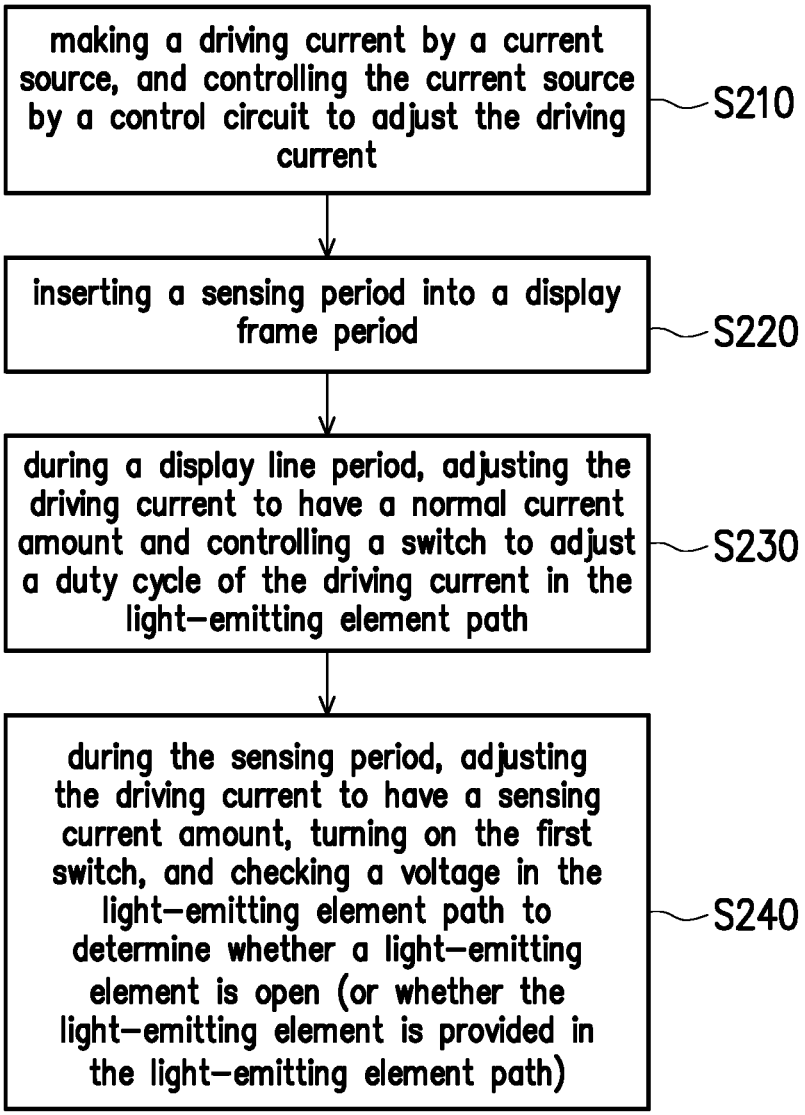
FIG. 2 is a schematic flow chart of a driving method of the display apparatus according to an embodiment of the disclosure.

FIG. 2 is a schematic flow chart of a driving method of the display apparatus according to an embodiment of the disclosure. With reference to FIG. 1A (or FIG. 1B) and FIG. 2, the driving device 110 includes a current source 111, the switch SW and a control circuit 112. In step S210, the current source 111 may make a driving current Id flow through a light-emitting element path of at least one sub-pixel circuit (e.g., the sub-pixel circuit 121) of the display panel 120. For instance, in the embodiment shown in FIG. 1A, the driving current Id provided by the current source 111 may pass through the switch SW first and flows to the light-emitting element LE. In the embodiment shown in FIG. 1B, the driving current Id sunk by the current source 111 may pass through the light-emitting element LE and flows to the switch SW. The control circuit 112 may output a control signal Sc1 to control the current source 111 to adjust the driving current Id in step S210.

The control circuit 112 may further output a control signal Sc2 to control the switch SW to adjust a duty cycle of the driving current Id in the light-emitting element path. For instance, the control signal Sc2 may be a pulse width modulation (PWM) signal. Based on adjustment of the duty cycle, brightness of the light-emitting element LE may also be correspondingly adjusted. Accordingly, based on a driving operation of the control circuit 112, the sub-pixel array of the display panel 120 may display an image.

When an unexpected factor occurs, the light-emitting element LE disposed in the sub-pixel circuit 121 may be detached (no light-emitting element LE is provided in the sub-pixel circuit 121). Alternatively, the light-emitting element LE in the sub-pixel circuit 121 is open due to poor soldering. Alternatively, the light-emitting element LE in the sub-pixel circuit 121 is open because the light-emitting element LE is defective. The aforementioned situations are collectively referred to as an abnormal open state. If a certain sub-pixel circuit (e.g., the sub-pixel circuit 121) of the display panel 120 is in the abnormal open state, when this sub-pixel circuit 121 is selected to be lit (that is, when the switch SW is turned on), a voltage of a channel connected to this sub-pixel circuit 121 is maintained at an unexpected high voltage level because a discharge path (the light-emitting element path of the sub-pixel circuit 121 is open) is not provided. This high voltage level may be coupled to an adjacent sub-pixel circuit, and the adjacent sub-pixel circuit is thereby abnormally lit. Therefore, the driving device 110 has to check whether the sub-pixel circuit (e.g., the sub-pixel circuit 121) is in the abnormal open state.

Figure 3:
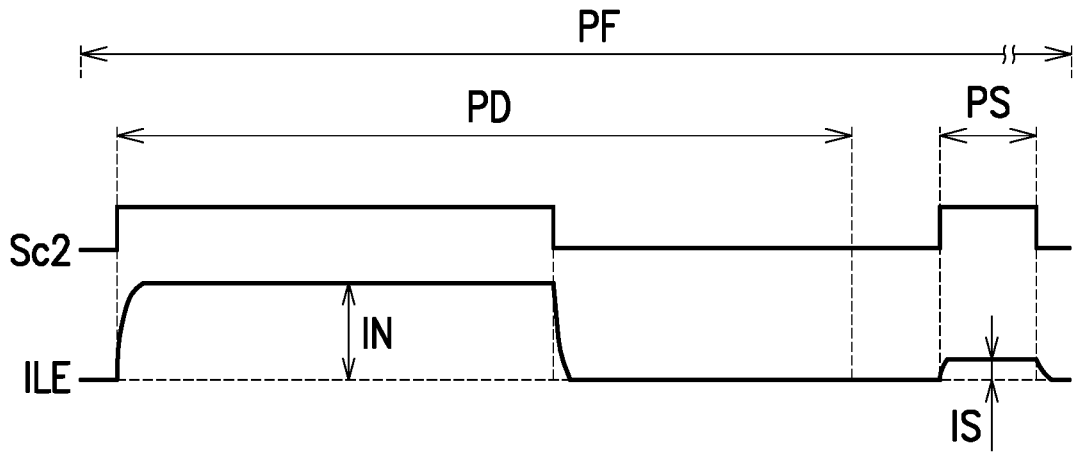
FIG. 3 and FIG. 4 are different examples of insertion of a sensing period PS into a display frame period PF.
Figure 4:
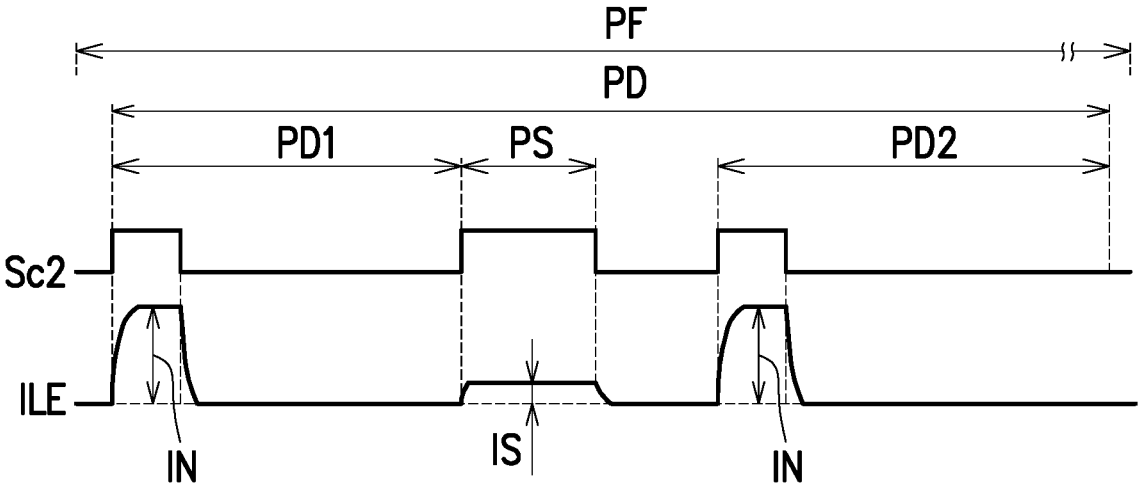

In step S220, the control circuit 112 may insert one sensing period into a display frame period. The display frame period includes a plurality of display line periods, and each one of the display line periods corresponds to one row of sub-pixel circuits in the sub-pixel array of the display panel 120. FIG. 3 and FIG. 4 are different examples of insertion of a sensing period PS into a display frame period PF. The display frame period PF includes a plurality of display line periods including a display line period PD shown in each one of FIG. 3 and FIG. 4, for example. In some exemplary embodiments, it is assumed that the display line period PD corresponds to the sub-pixel circuit 121. Sc2 shown in each one of FIG. 3 and FIG. 4 represents a waveform and a time sequence of the control signal Sc2 shown in FIG. 1A and FIG. 1B, and ILE shown in each one of FIG. 3 and FIG. 4 represents the driving current flowing through the light-emitting element LE shown in FIG. 1A and FIG. 1B. In the example shown in FIG. 3, the sensing period PS does not overlap with the display line period PD. In the example shown in FIG. 4, the display line period PD is at least be divided into a sub-period PD1 and a sub-period PD2, and the sensing period PS is disposed in the display line period PD between the sub-period PD1 and the sub-period PD2. Accordingly, the driving device 110 may perform sensing (detecting) in a display period at any time to determine whether the light-emitting element LE of the sub-pixel circuit 121 is in the abnormal open state.

With reference to FIG. 1A to FIG. 4, during the display line period PD (step S230), the control circuit 112 may control the current source 111 to adjust the driving current Id to have a normal current amount IN as shown in FIG. 3 and FIG. 4. During the display line period PD, the control circuit 112 controls the switch SW with a pulse width modulation signal corresponding to sub-pixel data as the control signal Sc2, so as to adjust the duty cycle of the driving current Id in the light-emitting element path of the sub-pixel circuit 121.

During the sensing period PS (step S240), the control circuit 112 may control the current source 111 to adjust the driving current Id to have a sensing current amount IS less than the normal current amount IN (as shown in FIG. 3 and FIG. 4). During the sensing period PS, the control circuit 112 turns on the switch SW with a pulse width modulation signal corresponding to the sensing period PS as the control signal Sc2 (as shown in FIG. 3 and FIG. 4).

During the sensing period PS, the control circuit 112 may check a voltage VLE in the light-emitting element path of the sub-pixel circuit 121 to determine whether the light-emitting element LE in the light-emitting element path is open (or whether the light-emitting element LE is provided in the light-emitting element path).

The sensing current amount IS and the normal current amount IN may be determined according to design needs. The sensing current amount IS of the driving current Id in the sensing period PS is less than the normal current amount IN of the driving current Id in the display line period PD, so that a user may not be easily (or is not) aware of the performance of sensing (detecting). The control circuit 112 may check the voltage VLE in the light-emitting element path of the sub-pixel circuit 121 during the sensing period PS, so as to detect (determine) whether the light-emitting element LE of the sub-pixel circuit 121 is in the abnormal open state.

Figure 5:
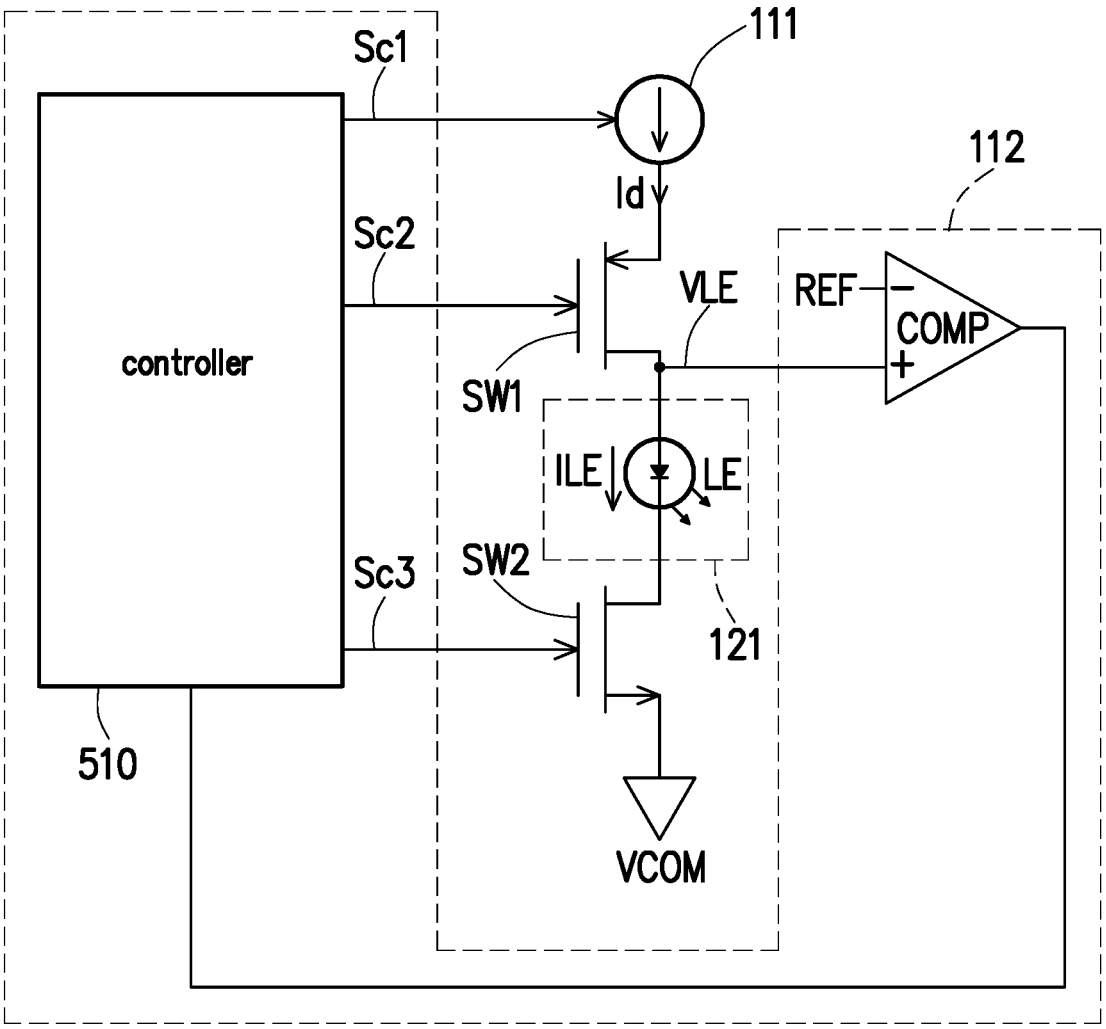
FIG. 5 is a schematic diagram illustrating circuit blocks of a control circuit and a sub-pixel circuit shown in FIG. 1A according to an embodiment of the disclosure.

FIG. 5 is a schematic diagram illustrating circuit blocks of the control circuit 112 and the sub-pixel circuit 121 shown in FIG. 1A according to an embodiment of the disclosure. In the embodiment shown in FIG. 5, the driving device 110 includes a switch SW1 and a switch SW2, the sub-pixel circuit 121 includes a light-emitting element LE, and the light-emitting element LE may include a LED. Description related to the switch SW1 and the light-emitting element LE shown in FIG. 5 may be deduced with reference to the description of the switch SW and the light-emitting element LE shown in FIG. 2. In the embodiment shown in FIG. 5, the light-emitting element LE is disposed in the light-emitting element path of the sub-pixel circuit 121. A first terminal (e.g., a source) and a second terminal (e.g., a drain) of the switch SW1 are respectively coupled to a current output terminal of the current source 111 and a first terminal (e.g., an anode) of the light-emitting element LE. The control circuit 112 outputs the pulse width modulation signal as the control signal Sc2 to a control terminal (e.g., a gate) of the switch SW1 during the display line period PD. The control circuit 112 outputs the pulse width modulation signal (the control signal Sc2) to the control terminal of the switch SW1 during the sensing period PS. A first terminal (e.g., a source) and a second terminal (e.g., a drain) of the switch SW2 are respectively coupled to a reference voltage (e.g., a common voltage VCOM) and a second terminal (e.g., a cathode) of the light-emitting element LE. The control circuit 112 outputs a scanning signal Sc3 to a control terminal (e.g., a gate) of the switch SW2. According to design requirements, the voltage level of the common voltage VCOM can be the ground voltage or other fixed voltages.

In the embodiment shown in FIG. 5, the control circuit 112 shown in FIG. 1A includes a controller 510 and a voltage comparator COMP. The controller 510 is coupled to the current source 111 to provide the control signal Sc1 to adjust the driving current Id. The controller 510 is further coupled to the sub-pixel circuit 121 to adjust the duty cycle of the driving current Id in the light-emitting element path of the sub-pixel circuit 121. Operations related to the controller 510, the control signal Sc2, and the driving current ILE shown in FIG. 5 may be found with reference to the description of 3 and FIG. 4, and description thereof is thus not repeated herein. A first input terminal (e.g., a non-inverted input terminal) of the voltage comparator COMP is coupled to the light-emitting element path of the sub-pixel circuit 121 to receive the voltage VLE. A second input terminal (e.g., an inverted input terminal) of the voltage comparator COMP receives a reference voltage REF. A level of the reference voltage REF may be determined according to design needs. An output terminal of the voltage comparator COMP is coupled to an input terminal of the controller 510 to provide a comparison result.

Figure 6:
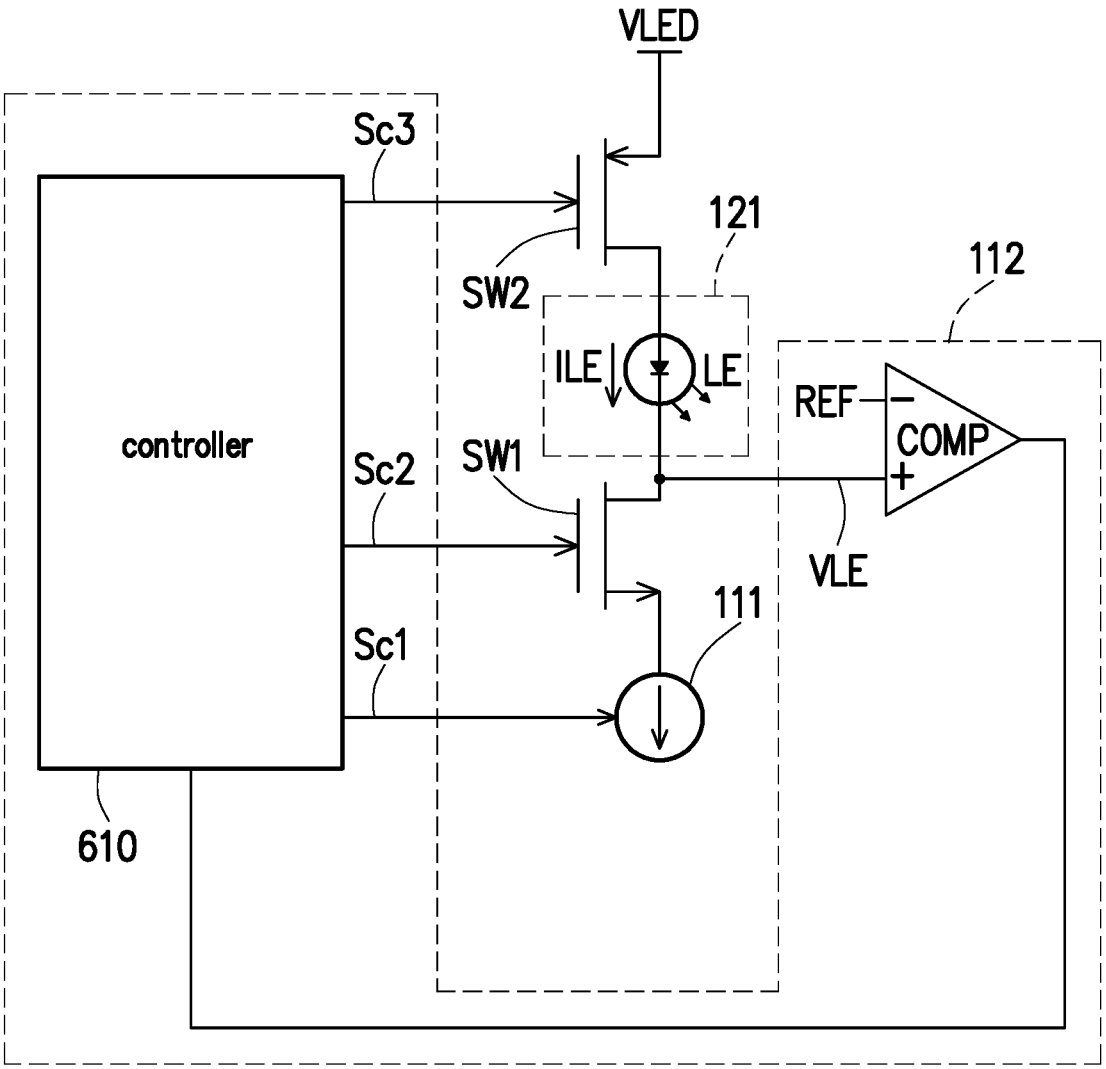
FIG. 6 is a schematic diagram illustrating circuit blocks of a control circuit and a sub-pixel circuit shown in FIG. 1B according to an embodiment of the disclosure.

FIG. 6 is a schematic diagram illustrating circuit blocks of the control circuit 112 and the sub-pixel circuit 121 shown in FIG. 1B according to an embodiment of the disclosure. In the embodiment shown in FIG. 6, the driving device 110 includes a switch SW1 and a switch SW2, the sub-pixel circuit 121 includes a light-emitting element LE, and the light-emitting element LE may include a LED. Description related to the switch SW1 and the light-emitting element LE shown in FIG. 6 may be deduced with reference to the description of the switch SW and the light-emitting element LE shown in FIG. 2. In the embodiment shown in FIG. 6, the light-emitting element LE is disposed in the light-emitting element path of the sub-pixel circuit 121. A first terminal (e.g., a source) and a second terminal (e.g., a drain) of the switch SW1 are respectively coupled to a current terminal of the current source 111 and a second terminal (e.g., a cathode) of the light-emitting element LE. The control circuit 112 outputs the pulse width modulation signal as the control signal Sc2 to a control terminal (e.g., a gate) of the switch SW1 during the display line period PD. The control circuit 112 outputs the pulse width modulation signal (the control signal Sc2) to the control terminal of the switch SW1 during the sensing period PS. A first terminal (e.g., a source) and a second terminal (e.g., a drain) of the switch SW2 are respectively coupled to a power voltage VLED and a first terminal (e.g., an anode) of the light-emitting element LE. The control circuit 112 outputs a scanning signal Sc3 to a control terminal (e.g., a gate) of the switch SW2. According to design requirements, the voltage level of the power voltage VLED can be any fixed voltage.

In the embodiment shown in FIG. 6, the control circuit 112 shown in FIG. 1B includes a controller 610 and a voltage comparator COMP. Description related to the controller 610 and the voltage comparator COMP shown in FIG. 6 may be deduced with reference to the description of the controller 510 and the voltage comparator COMP shown in FIG. 5, and description thereof is thus not repeated herein.

According to different design needs, the control circuit 112 and/or a block of the controller 510 may be implemented in the form of hardware, firmware, software (i.e., a program), or a combination of the majority of the foregoing three.

In the form of hardware, the control circuit 112 and/or the block of the controller 510 may be implemented in the form of a logic circuit on an integrated circuit. Related functions of the control circuit 112 and/or the controller 510 may be implemented as hardware through using hardware description languages (e.g., Verilog HDL or VHDL) or other suitable programming languages. For instance, the related functions of the control circuit 112 and/or the controller 510 may be implemented in one or a plurality of controllers, a micro controller, a micro processor, an application-specific integrated circuit (ASIC), a digital signal processor (DSP), a field programmable gate array (FPGA), and/or various logic blocks, modules, and circuits in other processing units.

In the form of software and/or firmware, the related functions of the control circuit 112 and/or the controller 510 may be implemented as programming codes. For instance, the control circuit 112 and/or the controller 510 may be implemented by using a general programming language (e.g., C, C++, or an assembly language) or other suitable programming languages. The programming code may be recorded/stored in a recording medium. In some embodiments, the recording medium includes, for example, read only memory (ROM), random access memory (RAM), and/or a storage device. The storage device includes a hard disk drive (HDD) a solid-state drive (SSD), or other storage devices. In some other embodiments, the recording medium may include a "non-transitory computer readable medium". For instance, a tape, a disk, a card, semiconductor memory, a programmable logic circuit, etc. may be used to be implemented as the non-transitory computer readable medium. A computer, a central processing unit (CPU), a controller, a micro controller, or a micro processor may read and execute the programming code from the recording medium to accomplish the related functions of the control circuit 112 and/or the controller 510. Further, the programming code may also be provided to the computer (or CPU) through any transmission medium (a communication network or a broadcast wave, etc.). The communication network includes, for example, Internet, a wired communication network, a wireless communication network, or other communication media.

In view of the foregoing, in the driving device 110 and the driving method of the display panel 120 provided by the embodiments, the sensing period PS may be inserted into the display frame period PF. Accordingly, the driving device 110 may perform sensing (detecting) in the display period (the display frame period PF) at any time to determine whether the light-emitting element LE of the sub-pixel circuit 121 is in the abnormal open state. The sensing current amount IS of the driving current Id in the sensing period PS is less than the normal current amount IN of the driving current Id in the display line period PD, so that a user may not be easily (or is not) aware of the performance of sensing (detecting). The control circuit 112 may check the voltage VLE (e.g., a terminal voltage of the light-emitting element LE) in the light-emitting element path of the sub-pixel circuit 121 during the sensing period PS, so as to detect (determine) whether the light-emitting element LE of the sub-pixel circuit 121 is in the abnormal open state.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driving device of a display panel, comprising:

a current source, configured to make a driving current flow through a light-emitting element path of at least one sub-pixel circuit of the display panel, wherein the light-emitting element path comprises a first switch and a second switch, a first terminal of the first switch is coupled to the current source, a second terminal of the first switch is coupled to a first terminal of a light-emitting element, a first terminal of the second switch is coupled to a reference voltage, and a second terminal of the second switch is coupled to a second terminal of the light-emitting element in the light-emitting element path; and a control circuit, configured to control the current source to adjust the driving current and control the first switch to adjust a duty cycle of the driving current in the light-emitting element path and configured to output a scanning signal to a control terminal of the second switch, wherein a sensing period is inserted into a display frame period, and the display frame period comprises at least one display line period corresponding to the at least one sub-pixel circuit, during the at least one display line period, the control circuit adjusts the driving current to have a normal current amount, and the control circuit controls the first switch to adjust the duty cycle of the driving current in the light-emitting element path with at least one first pulse width modulation signal corresponding to at least one piece of sub-pixel data, during the at least one display line period, the control circuit outputs the at least one first pulse width modulation signal to a control terminal of the first switch;

during the sensing period, the control circuit adjusts the driving current to have a sensing current amount less than the normal current amount, the control circuit turns on the first switch with a second pulse width modulation signal corresponding to the sensing period, and the control circuit checks a voltage in the light-emitting element path to determine whether the light-emitting element in the light-emitting element path is open or whether the light-emitting element is provided in the light-emitting element path, and during the sensing period, the control circuit outputs the second pulse width modulation signal to the control terminal of the first switch.

2. The driving device according to claim I, wherein the light-emitting element comprises a light-emitting diode.

3. The driving device according to claim 1, wherein the control circuit comprises:

controller, coupled to the current source to adjust the driving current and coupled to a control terminal of the first switch to adjust the duty cycle of the driving current in the light-emitting element path; and a voltage comparator, having an output terminal coupled to the controller, wherein a first input terminal of the voltage comparator is coupled to the light-emitting element path to receive the voltage, and a second input terminal of the voltage comparator receives a reference voltage.

4. The driving device according to claim 1, wherein the sensing period does not overlap with the at least one display line period.

5. The driving device according to claim 1, wherein the at least one display line period is divided into at least a first sub-period and a second sub-period, and the sensing period is disposed in the at least one display line period and between the first sub-period and the second sub-period.

6. A driving device of a display panel comprising:

a current source, configured to make a driving current flow through a light-emitting element path of at least one sub-pixel circuit of the display panel, wherein the light-emitting element path comprises a first switch and a second switch, a first terminal and a second terminal of the second switch are respectively coupled to a power voltage and a first terminal of the light-emitting element, and a first terminal and a second terminal of the first switch are respectively coupled to the current source and a second terminal of the light-emitting element; and a control circuit, configured to control the current source to adjust the driving current and control the first switch to adjust a duty cycle of the driving current in the light-emitting element path, wherein a sensing period is inserted into a display frame period, and the display frame period comprises at least one display line period corresponding to the at least one sub-pixel circuit, during the at least one display line period, the control circuit adjusts the driving current to have a normal current amount, and the control circuit controls the first switch to adjust the duty cycle of the driving current in the light-emitting element path with at least one first pulse width modulation signal corresponding to at least one piece of sub-pixel data, during the sensing period, the control circuit adjusts the driving current to have a sensing current amount less than the normal current amount, the control circuit turns on the first switch with a second pulse width modulation signal corresponding to the sensing period, and the control circuit checks a voltage in the light-emitting element path to determine whether a light-emitting element in the light-emitting element path is open or whether the light-emitting element is provided in the light-emitting element path, the control circuit outputs a scanning signal to a control terminal of the second switch, the control circuit outputs the at least one first pulse width modulation signal to a control terminal of the first switch during the at least one display line period, and the control circuit outputs the second pulse width modulation signal to the control terminal of the first switch during the sensing period.

7. A driving method of a display panel, comprising:

making a driving current flow through a light-emitting element path of at least one sub-pixel circuit of the display panel by a current source, wherein the light-emitting element path comprises a first switch, and a first terminal of the first switch is coupled to the current source;

controlling the current source by a control circuit to adjust the driving current;

controlling the first switch by the control circuit to adjust a duty cycle of the driving current in the light-emitting element path;

outputting a scanning signal by the control circuit to a control terminal of a second switch, wherein a first terminal of the second switch is coupled to one of a reference voltage and a power voltage, a second terminal of the second switch is coupled to one of a first terminal and a second terminal of a light-emitting element in the light-emitting element path, a second terminal of the first switch is coupled to another one of the first terminal and the second terminal of the light-emitting element;

inserting a sensing period into a display frame period, wherein the display frame period comprises at least one display line period corresponding to the at least one sub-pixel circuit;

during the at least one display line period, adjusting the driving current to have a normal current amount by the control circuit and controlling the first switch to adjust the duty cycle of the driving current in the light-emitting element path by the control circuit with at least one first pulse width modulation signal corresponding to at least one piece of sub-pixel data;

during the at least one display line period, outputting the at least one first pulse width modulation signal by the control circuit to a control terminal of the first switch;

during the sensing period, adjusting the driving current by the control circuit to have a sensing current amount less than the normal current amount, turning on the first switch by the control circuit with a second pulse width modulation signal corresponding to the sensing period, and checking a voltage in the light-emitting element path by the control circuit to determine whether the light-emitting element in the light-emitting element path is open or whether the light-emitting element is provided in the light-emitting element path; and during the sensing period, outputting the second pulse width modulation signal by the control circuit to the control terminal of the first switch.

8. The driving method according to claim 7, wherein the light-emitting element comprises a light-emitting diode.

9. The driving method according to claim 7, wherein the sensing period does not overlap with the at least one display line period.

10. The driving method according to claim 7, further comprising:

dividing the at least one display line period into at least a first sub-period and a second sub-period; and disposing the sensing period in the at least one display line period and between the first sub-period and the second sub-period.

* * * * *